US005186508A

United States Patent [19]

Beecher

[11] Patent Number: 5,186,508

[45] Date of Patent: Feb. 16, 1993

[54] TRAILER LIFTING FOOT EXTENDER

[75] Inventor: Dennis L. Beecher, Hammonton, N.J.

[73] Assignee: Consolidated Rail Corporation, Philadelphia, Pa.

[21] Appl. No.: 750,889

[22] Filed: Aug. 26, 1991

[51] Int. Cl.[5] ..... B66C 1/22

[52] U.S. Cl. ..... 294/81.51; 294/67.31

[58] Field of Search ..... 294/81.51, 67.31, 67.2, 294/67.3, 81.2, 81.5, 81.56, 81.6, 82.1, 902

[56] References Cited

U.S. PATENT DOCUMENTS

| | | | |
|---|---|---|---|
| 2,623,776 | 12/1952 | Breslav | 294/81.51 |
| 2,670,985 | 3/1954 | King | 294/67.31 |
| 3,086,661 | 4/1963 | De Stasi | 212/11 |
| 3,567,266 | 3/1971 | Bridge | 294/67 |
| 4,355,833 | 10/1982 | Dunbar | 294/81.51 |
| 4,747,745 | 5/1988 | Pippes et al. | 414/460 |

FOREIGN PATENT DOCUMENTS

| | | | |
|---|---|---|---|
| 33086 | 2/1990 | Japan | 294/81.51 |

*Primary Examiner*—Charles A. Marmor
*Assistant Examiner*—Joseph D. Pape
*Attorney, Agent, or Firm*—Woodcock Washburn Kurtz Mackiewicz & Norris

[57] ABSTRACT

An extender assembly is provided for the lifting foot of a mobile crane used to lift trailers and the like. The extender is comprised of left and right extender pads attached to and spaced apart along a frame such that when the frame is rotatably coupled to the lifting foot via a clevis joint, the extender pads are disposed adjacent each side of the food pad. The lifting foot is capable of being used with the extender pads in either the raised or lowered position depending on the access for foot pad engagement available on the trailer being lifted. The extender assembly is adapted to allow it to be maintained in the raised position once it is manually placed therein and to be automatically rotated into the lowered position by resting the lifting foot on the ground.

20 Claims, 5 Drawing Sheets

TRAILER LIFTING FOOT EXTENDER

FIELD OF THE INVENTION

The current invention concerns a lifting foot for a mobile crane. More specifically, the current invention concerns an extender for such a lifting foot which allows the foot to engage the underside of a trailer along either a longer or a shorter span.

BACKGROUND OF THE INVENTION

During transportation, trailers are often loaded onto rail cars. A mobile crane 1 for loading such a trailer 2 is shown in FIG. 1. Such mobile cranes 1 typically having a lift carriage 4 containing four arms 5. When not in use, the arms 5 are rotated upward into a storage position about pivot joints 28, as shown in phantom in FIG. 2. When the lift carriage 4 is in position over the trailer 2, the arms 5 are rotated downward and the lower portion of each arm is extended along the sides of the trailer so that a lifting foot 6, attached to the distal end of each arm, can engage the underside of the trailer, as shown in FIGS. 2 and 3.

As shown in FIG. 3, each lifting foot 6 is comprised of front and back plates 9 and 10, respectively, to which a pad 11 is attached. In use, the pad 11 extends in a horizontal plane to allow it to contact the underside of the trailer 2. A cushion 12 is attached to the active surface of the pad 11. The lifting foot 6 is rotatably coupled to the distal end of the arm 5 by a clevis pin 13. The clevis pin 13 allows the foot 6 to automatically swivel into the proper orientation—that is, with the pad 11 extending in a horizontal plane—for engaging the underside of the trailer 2 when the arms 5 are lowered.

In the past, lifting feet were designed to load trailers approved by the Association of American Railroads (AAR). Such trailers have a support beam 7, shown in FIG. 1, formed on their bottom to distribute the weight of the trailer when held by the feet 6. In addition, some AAR trailers, such as trailer 3 shown in FIG. 2, have a drop frame 8 extending downward from their underside which limits the space available for engagement of the foot. Consequently, the length of the pad 11 has traditionally been limited to 30 inches, the maximum length foot which is capable of engaging a drop frame trailer 3.

The aforementioned limitation in the length of the lifting foot pad 11 presented no structural problem in AAR approved trailers due to the presence of the support beam 7, as previously discussed. However, highway trailers, which need not obtain AAR approval and, typically, do not incorporate the support beam 7, can also be transported on rail cars subject to certain limitations. Unfortunately, in the absence of the support beam 7, the 30 inch long pad 11 of a traditional lifting foot 6 is not long enough to adequately distribute the weight of the trailer, thereby creating a risk of structural damage to the trailer.

Accordingly, it would be desirable to develop a lifting foot which has a pad small enough to engage AAR approved trailers with drop frames yet which could readily be made large enough to support highway trailers.

SUMMARY OF THE INVENTION

It is an object of the current invention to provide a lifting foot having both standard and extended configurations such that the lifting foot pad was small enough to engage AAR approved trailers with drop frames when in a standard configuration yet which could readily be made large enough to support highway trailers when in an extended configuration.

It is another object of the current invention that such a lifting foot be capable of being readily placed and maintained in either the standard or extended configuration with a minimum of labor.

These and other objects are accomplished in an apparatus for lifting containers, such as trailers and the like, having a lifting arm and a lifting foot rotatably coupled thereto. The lifting foot has (i) a first pad, (ii) second and third pads which are disposed on each side of the first pad and which rotate more than 90° in first and second parallel planes perpendicular to the plane of the first pad, (iii) means, defining a rotation axis, for rotatably coupling the first pad to the second and third pads, and (iv) a frame attached to the second and third pads and forming an extender assembly therewith which is rotatable with respect to the first pad about the rotation axis. The extender assembly is adapted to assume a raised position when rotated in a first direction and a lowered position when rotated in a second direction and has means for limiting the rotation of the second and third pads about the axis in the first and second directions, respectively, to a predetermined amount. The extender assembly is balanced such that rotation of the assembly in the first direction beyond that at which the second and third pads are vertically oriented results in a moment tending to resist rotation of the assembly in the second direction.

DESCRIPTION OF THE PREFERRED EMBODIMENT

Figure 4:
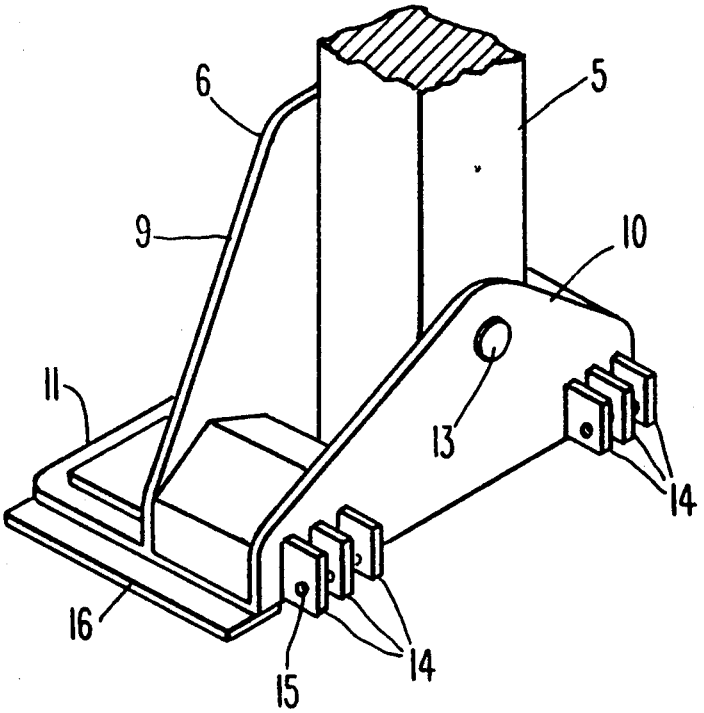
FIG. 4 is an isometric view of the outboard face of the foot shown in FIG. 3 after modification according to the current invention.
Figure 5:
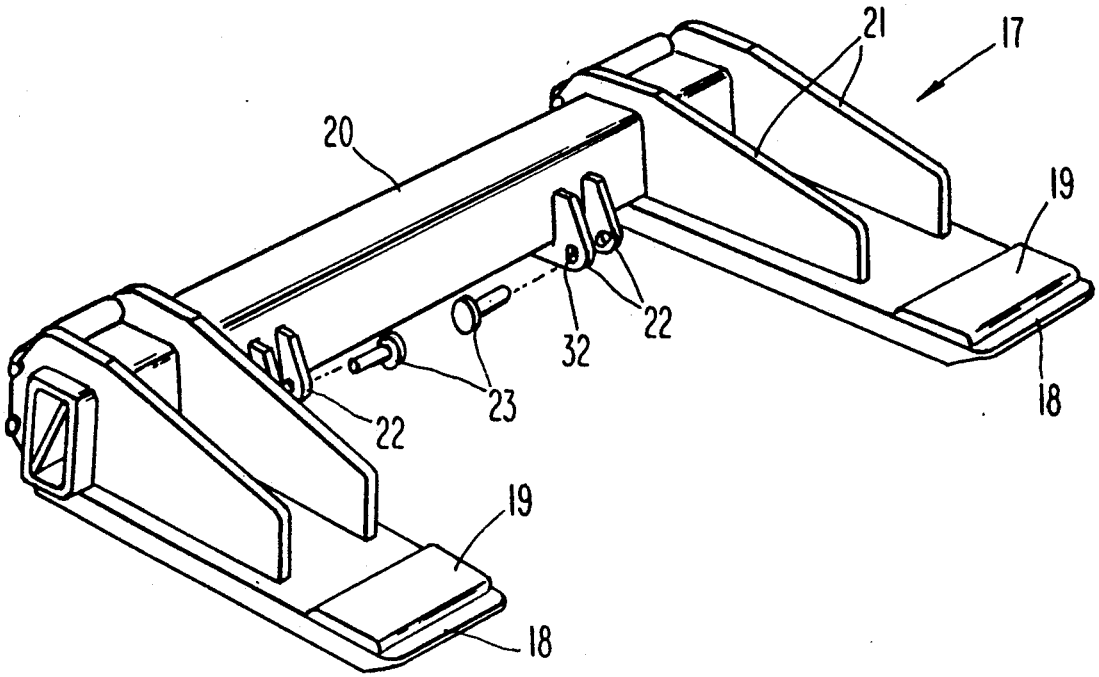
FIG. 5 is an isometric view of the extender assembly of the current invention.

There is shown in FIG. 4, a lifting foot 6 according to the prior art after it has been modified according to the current invention to receive the lifting foot extender assembly 17 shown in FIG. 5. The modification involves (i) welding six lugs 14 to the rear face of the rear plate 10 and (ii) welding tabs 16 on each side of the foot at the underside of the pad 11.

The foot lugs 14 have holes 15 which ar adapted to lineup with holes 32 in four mating lugs 22 welded to a frame 20 of the extender assembly 17. The extender assembly 17 is installed on the foot 6 by inserting the extender lugs 22 between the foot lugs 14 and inserting pins 23 through the holes 15 and 32. Thus, the extender assembly 17 is rotatably attached to the foot 6 via a clevis joint comprised of foot lugs 14, extender lugs 22 and pins 23. Moreover, the centerline of the pins 23 define an axis about which the extender assembly 17 rotates with respect to the foot 6. As a result of the clevis pin 13, which allows the foot 6 to rotate on the arm 5, the axis defined by pins 23 is horizontally oriented.

Figure 7:
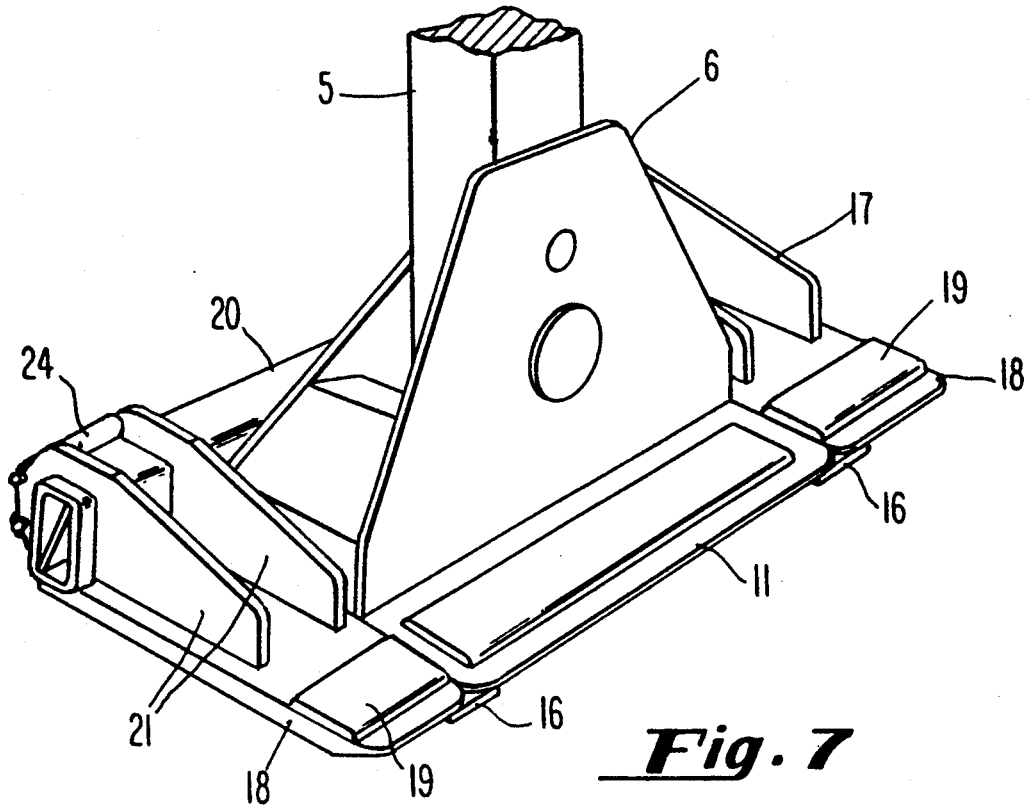
FIGS. 7 and 8 show the lifting foot of FIG. 3 after the extender assembly of FIG. 5 has been added thereto, with the extender pads in the lowered and raised positions, respectively.

As shown in FIG. 7, the extender assembly 17 has left and right extender pads 18 which are welded to the frame 20 and spaced thereon so as to be disposed adjacent opposing sides of the foot 6. Support brackets 21 are attached to the extender pads 18 to provide stiffness, and cushions 19 are attached to the active surface of the extender pads. In the preferred embodiment, the frame 20 is a tubular member having a rectangular cross-section. As a result of the aforementioned extender assembly/foot clevis joint, the two extender pads 18 and the frame 20 each rotate in parallel vertical planes which are perpendicular to the horizontal plane in which the foot pad 11 extends.

As shown in FIG. 7, the extender pads 18 have been rotated downward into their lowered position. The pads 18 are maintained in their lowered position by the tabs 16 which act as stops against which the underside of the extender pads 18 bear and which ensure that the extender pads 18 are aligned with the foot pad 11. In addition, in the lowered position, the frame 20 bears against the rear face of the lugs 14 which provide an additional stop. As shown in FIG. 7, in the lowered position, the extender pads 18 considerably increase the bearing surface of the foot, thereby better distributing the weight of the trailer along its frame in the absence of the support beam 7 used in AAR approved trailers.

Figure 8:
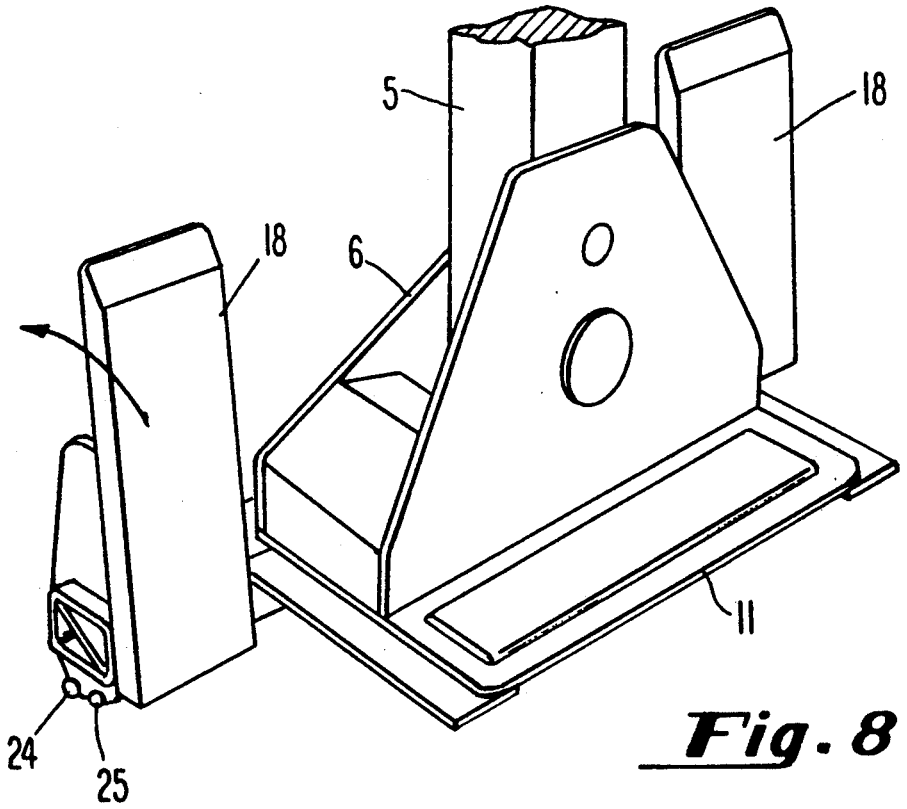

As shown in FIG. 8, the extender pads 18 can be rotated upward into a raised position. In this position, the foot 6 can engage the underside of an AAR approved drop frame trailer 3 in the traditional manner without interference by the extender pads 18.

Figure 9:
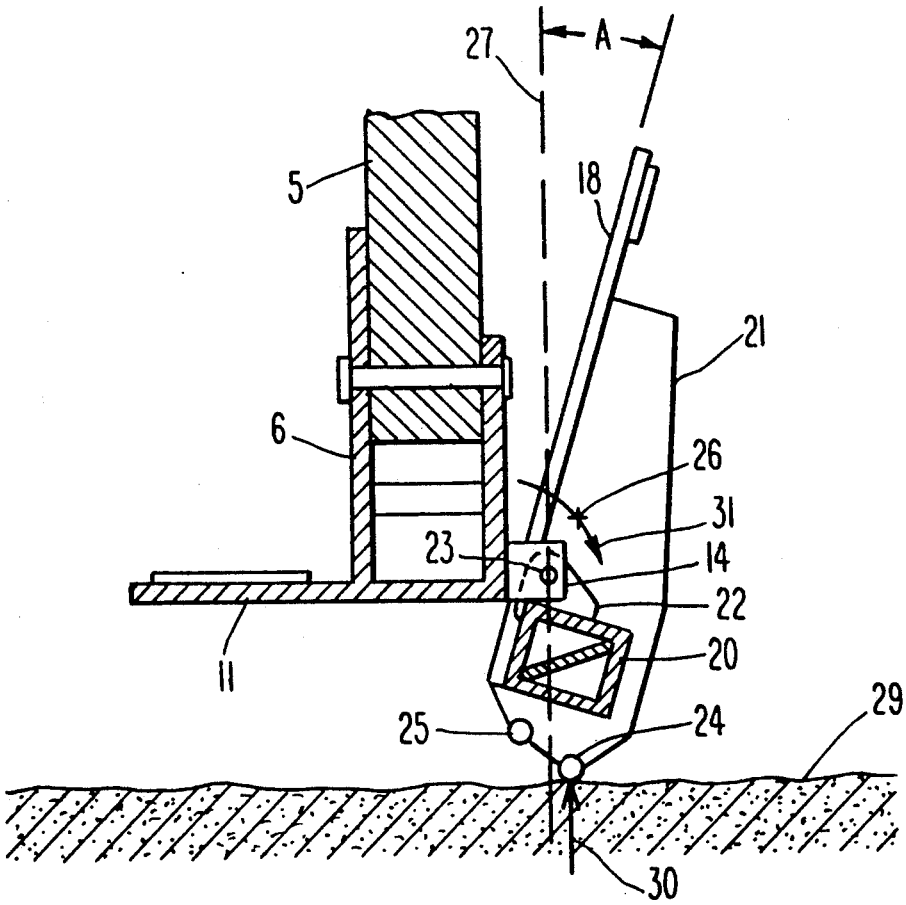
FIG. 9 is a vertical cross-section through the lifting foot shown in FIG. 8 with the extender pads in the raised position.

As shown in FIG. 9, the clevis joint is adapted to allow the extender pads 18 to rotate upward—that is, clockwise when viewed as in FIG. 9—by an angle in excess of 90°, so that the pads 18 form an angle with the foot pad 11 in excess of 90°. In the preferred embodiment, the amount "A" by which this angle exceeds 90° is approximately 20°. Clockwise rotation beyond the angle A is prevented by the foot lugs 14, which act as stops against which the frame 20 bears.

According to an important aspect of the current invention, the extender assembly 17 is balanced such that its center of gravity 26 is located as shown in FIG. 9. Being thus located, the center of gravity 26 is oriented with respect to the aforementioned axis about which the clevis joint rotates so that when the extender assembly 17 is rotated clockwise into its raised position, as shown in FIG. 9, the center of gravity 26 rotates in the clockwise direction past a vertical plane 27 extending through the clevis joint axis. As a result, the weight of the extender assembly 17 creates a moment 31 acting about the clevis joint which resists counterclockwise rotation of the extender pads 18 into the lowered position. Thus, once the extender pads 18 have been placed in the raised position, they will maintain themselves in this position until a force is applied to lower them.

Figure 6:
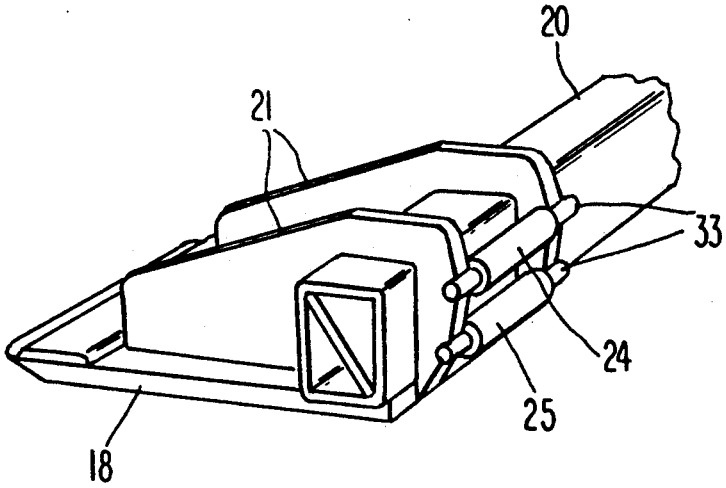
FIG. 6 is a view of the rear portion of one end of the extender assembly shown in FIG. 5.

As shown in FIG. 6, upper and lower tubular rollers 24 and 25, respectively, are mounted on round bars 33 which are attached to the rear edges of the support brackets 21 at each end of the assembly 17. As shown in FIG. 9, the upper roller 24 is oriented with respect to the aforementioned clevis joint axis such that when the extender pads 18 are in the raised position, the upper roller is disposed below the axis and outboard—that is, to the right in FIG. 9—of the vertical plane 27. In addition, the upper roller 24 is located so that it is the downward most extending member of the foot assembly 16. Consequently, when the foot is lowered to the ground 29, the upper roller 24 contacts the ground first, whereupon the ground imposes an upward acting reaction force 30 on the extender assembly 17 through the upper roller 24.

Figure 10:
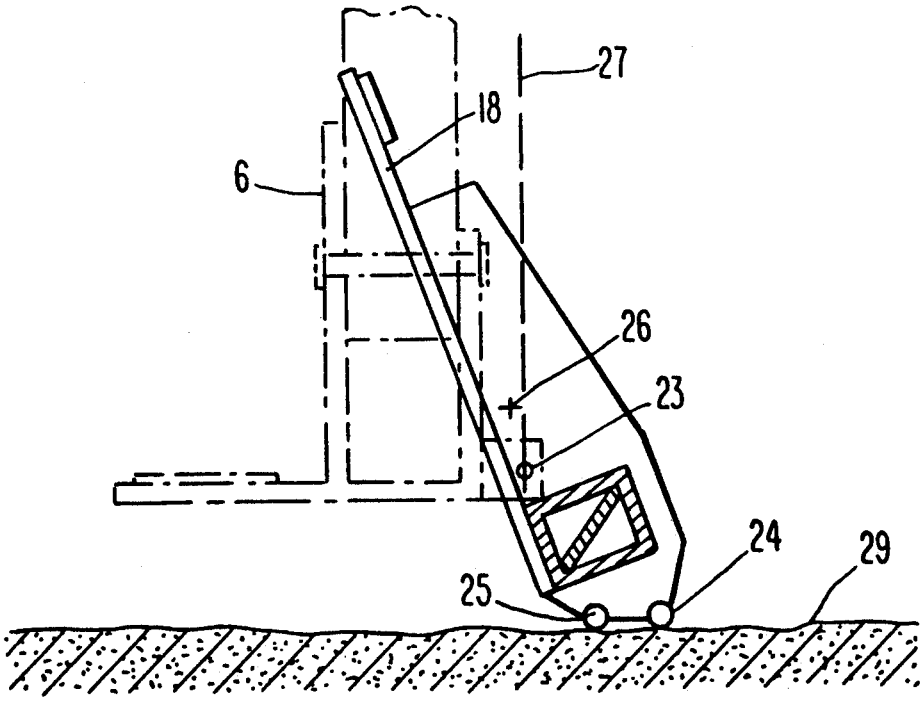
FIG. 10 is a view similar to FIG. 9 with extender pads rotated forwardly somewhat.

As a result of the aforementioned orientation of the upper roller 24 with respect to the clevis joint axis, the force 30 creates a moment about the clevis joint which opposes moment 31. This opposing moment causes the extender assembly 17 to rotate forward toward the lowered position so that lower roller 25 also contacts the ground, as shown in FIG. 10. In the position shown in FIG. 10, the center of gravity 26 is disposed inboard of the vertical plane 27. As a result, the weight of the extender assembly now creates a moment acting about the clevis joint which tends to rotate the extender pads 18 further forward into their lowered position. This arrangement allows the extender pads 18 to be lowered by the simple expedient of lowering the foot 6 to the ground.

Figure 1:
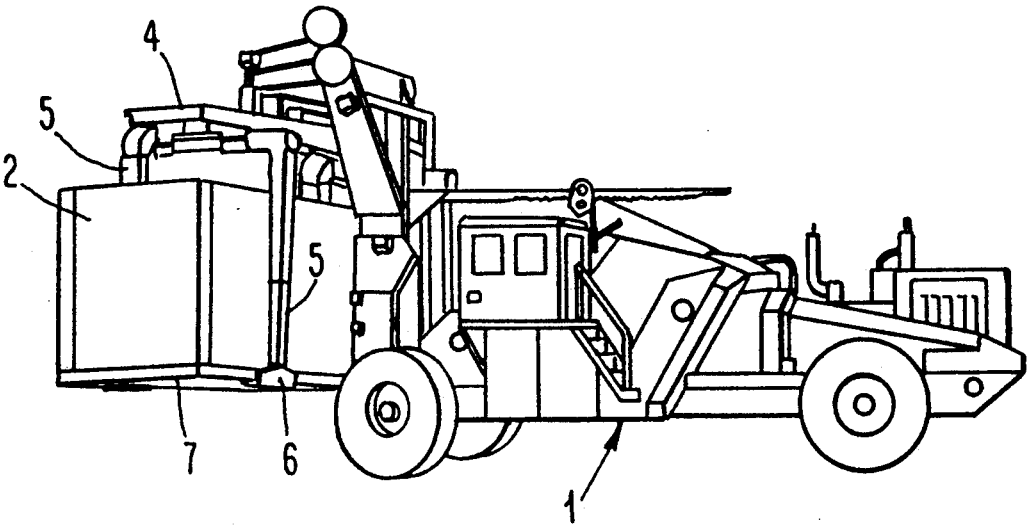
PRIOR ART Fig. 1
FIG. 1 is an isometric view of a mobile crane lifting an AAR approved trailer, according to the prior art.
Figure 2:
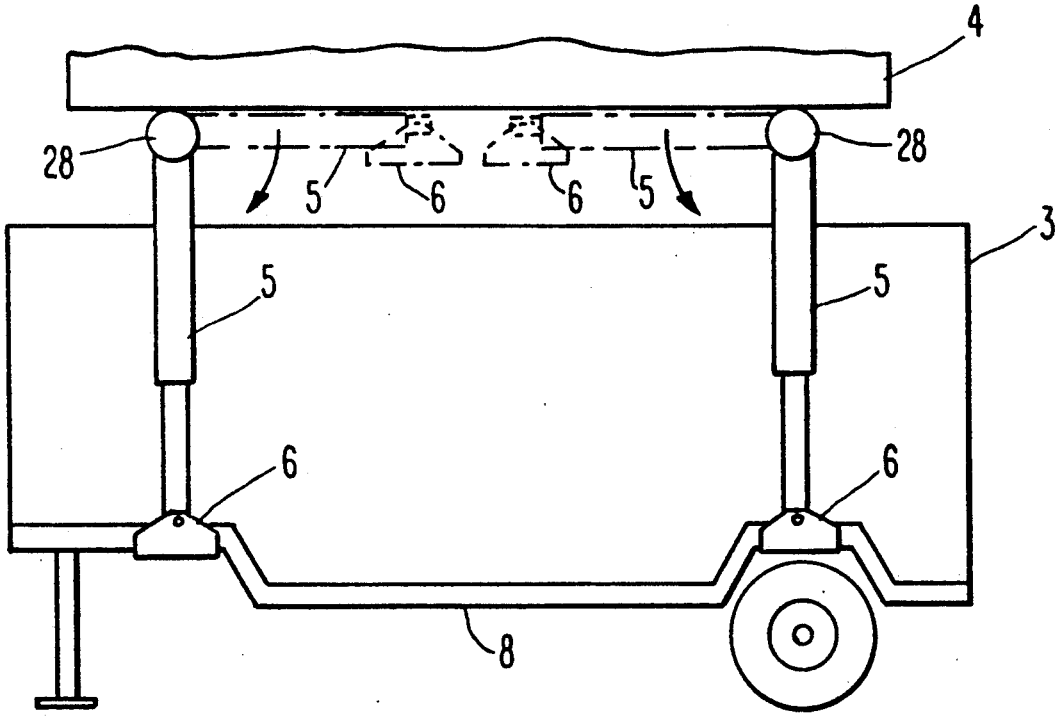
PRIOR ART Fig. 2
FIG. 2 is an elevation of an AAR approved trailer, having a drop frame, in the process of being lifted, according to the prior art.
Figure 3:
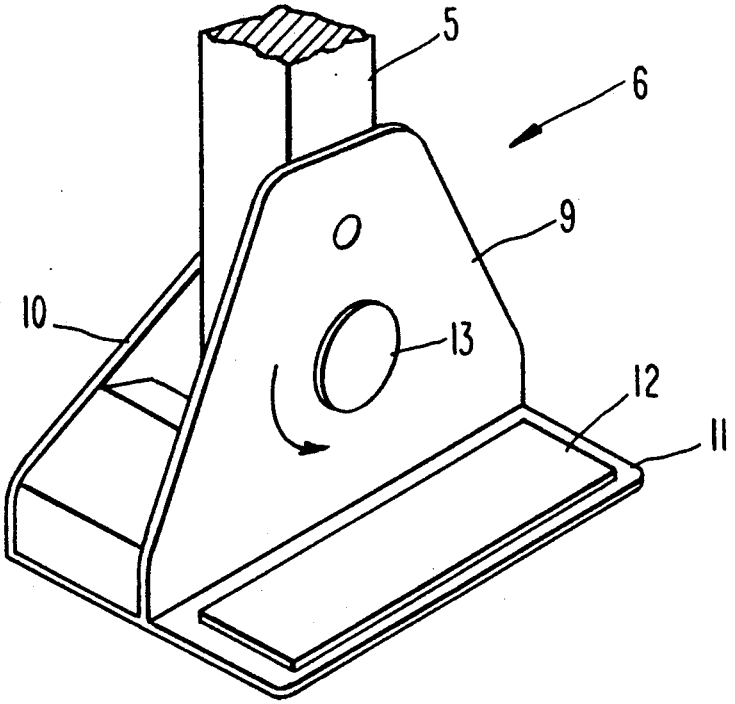
PRIOR ART Fig. 3
FIG. 3 is an isometric view of the inboard face of a lifting foot according to the prior art.

In operation, the extender pads are manually rotated into their raised position, as shown in FIG. 9, and maintained there by the aforementioned balance arrangement. If the trailer to be lifted is of the AAR approved type having a drop frame 8, as shown in FIG. 2, the feet 6 are allowed to engage the trailer underside with the extender pads 18 in the raised position. With the feet in this configuration, the weight of the trailer is distributed on the four 30 inch long pads, relying on the beam 7 to distribute the load to the trailer frame. If, however, a highway trailer is to be lifted, the foot is lowered so that the upper roller 24 contacts to the ground, thereby causing the extender pads to rotate forward into the lowered position without further manual assistance. The feet are then positioned to engage the underside of the trailer as before, except that now its weight is distributed over the eight extender pads as well as the four 30 inch long standard pads. In the preferred embodiment, each extender pad is 9 inches long so that the total contact area is increased by 60% when the extender pads are utilized, thereby more evenly distributing the load to the trailer frame.

The present invention may be embodied in other specific forms without departing from the spirit or essential attributes thereof and, accordingly, reference should be made to the appended claims, rather than to the foregoing specification, as indicating the scope of the invention.

What is claimed:

1. In an apparatus for lifting containers having a lifting arm, a a device for supporting an object to be lifted, comprising:

a) a lifting foot connected to said arm and having a first pad extending in a substantially horizontal plane for engaging said object to be lifted;

b) second and third pads disposed on opposing sides, respectively, of said first pad; and c) means for rotatably coupling said second and third pads to said lifting foot so that said second and third pads rotate into first and second positions, said first position placing said second and third pads into a substantially horizontal plane for engaging said object to be lifted, said second position placing said second and third pads into a plane disposed at a predetermined angle from said horizontal plane for preventing said second and third pads from engaging said object to be lifted.

2. The lifting device according to claim 1, wherein said second and third pads rotate in first and second parallel planes.

3. The lifting device according to claim 2, wherein said first and second planes are vertically oriented.

4. The lifting device according to claim 2, wherein said lifting foot is rotatably connected to said arm.

5. The lifting device according to claim 1, wherein said predetermined angle is more than 90°.

6. In an apparatus for lifting containers having a lifting arm, a device for supporting an object to be lifted, comprising:

a) a lifting foot connected to said arm and having a first pad;

b) second and third pads disposed on opposing sides, respectively, of said first pad;

c) means for rotatably coupling said lifting foot to said second and third pads, said rotatable coupling means defining a rotation axis; and d) a frame attached to said second and third pads, said frame and said second and third pads forming an assembly rotatable with respect to said first pad about said axis.

7. The lifting device according to claim 6, wherein said rotatable coupling means comprises a clevis joint.

8. The lifting device according to claim 6, wherein said assembly is adapted to assume a raised position when rotated in a first direction and a lowered position when rotated in a second direction, and further comprising means for limiting said rotation of said assembly about said axis in said first and second direction, respectively, to a predetermined amount.

9. The lifting device according to claim 8, wherein said rotation limiting means comprises first and second tabs attached to said opposing sides of said first pad and against which said second and third pads bear when said assembly is in said lowered position.

10. The lifting device according to claim 8, wherein said second rotation limiting means comprises said frame being adapted to contact said rotatable coupling means when said assembly is in said raised position.

11. The lifting foot according to claim 8, wherein said predetermined amount of rotation is at least 90°.

12. The lifting device according to claim 8, wherein the center of gravity of said assembly is located relative to said axis such that when said assembly has been rotated into said raised position said center of gravity has rotated in said first direction past a vertical plane disposed through said axis.

13. The lifting device according to claim 8, wherein said axis is oriented approximately horizontally, and wherein said assembly has a center of gravity located with respect to said axis such that rotation of said assembly in said first direction into said raised position created a moment tending to resist rotation of said assembly in said second direction.

14. In an apparatus for lifting trailers having a lifting arm and a lifting foot coupled to said lifting arm, said lifting foot having a pad capable of extending in a substantially horizontal plane so as to be insertable under said trailer to provide a first load bearing area for lifting said trailer, an extender for said lifting foot for providing additional load bearing area, comprising:

a) a frame;

b) means for rotatably coupling said frame to said lifting foot, whereby said frame rotates at least 90° in a vertical plane into raised and lowered positions; and c) an extender pad connected to said frame and forming an assembly therewith, said extender pad connected to said frame so that (i) when said frame is rotated into said lowered position said extender pad is disposed adjacent to said lifting foot pad and extends in said substantially horizontal plane so as to be insertable under said trailer to provide a second load bearing area substantially coplanar with said first load bearing area for lifting said trailer, and (ii) when said frame is rotated into said raised position said extender pad is not disposed adjacent to said lifting foot pad and extends in said plane at a predetermined angle to said horizontal plane so as to not be insertable under said trailer.

15. The lifting foot extender according to claim 14, wherein said rotatable coupling means is adapted to allow said assembly to be rotated downward in a first direction into said lowered position and upward in a second direction into said raised position, and wherein said predetermined angle is at least 90°.

16. The lifting foot extender according to claim 15, wherein said rotatable coupling means defines a horizontally extending axis, and wherein said assembly has a center of gravity located with respect to said axis so as to create a moment about said axis which acts in said second direction when said assembly is rotated more than 90° in said second direction.

17. The lifting foot extender according to claim 16, wherein said assembly has means for causing said assembly to rotate in said first direction in response to an upward acting force applied to said assembly when said assembly is in the raised position.

18. The lifting foot extender according to claim 17, wherein said first direction rotation causing means comprises said assembly having a contact member, said contact member being the most downward extending portion of said assembly when said assembly is in said raised position, said contact member and the center of gravity of said assembly disposed on the same side of a vertical plane extending through said axis when said assembly is in said raised portion.

19. A method of lifting a trailer using a lifting foot having a first pad and an extender pad rotatably coupled and adjacent to said first pad, said extender pad capable of assuming raised and lowered positions and having means for causing said extender pad to rotate into said lowered position by applying an upward acting force to said extender pad, comprising the steps of:

a) placing said extender pad in the raised position;

b) determining if there is sufficient access on said trailer for engagement of both said first pad and said extender pad;

c) lowering said lifting foot so that said extender pad contacts the ground, thereby applying an upward acting force causing said extender pad to rotate into said lowered position and then placing said first pad and said extender pad into engagement with said trailer, if it has been determined in step (b) that there is sufficient access for engagement of said extender pad; and d) placing said first pad into engagement with said trailer without lowering said lifting foot, so that said extender pad does not rotate into said lowered position, if it has been determined in step (b) that there is not sufficient access for engagement of said extender pad.

20. The lifting foot extender according to claim 14, wherein said rotatable coupling means defines a rotation axis, and wherein said assembly is rotatable with respect to said lifting foot about said axis.

* * * * *